US007392557B1

(12) United States Patent
Kohlman

(10) Patent No.: US 7,392,557 B1
(45) Date of Patent: Jul. 1, 2008

(54) CUSHION WITH GROUP OF MUTUALLY INFLATABLE AND DEFLATABLE CELLS AND SYSTEM FOR SELECTIVELY ISOLATING ONE OR MORE CELLS FROM THE GROUP FOR INDEPENDENT INFLATION AND DEFLATION

(75) Inventor: Steve Kohlman, Clarks Grove, MN (US)

(73) Assignee: Aquila Corporation of Wisconsin, La Crosse, WI (US)

( * ) Notice: Subject to any disclaimer, the term of this patent is extended or adjusted under 35 U.S.C. 154(b) by 230 days.

(21) Appl. No.: 11/095,002

(22) Filed: Mar. 31, 2005

(51) Int. Cl.
*A47C 27/10* (2006.01)

(52) U.S. Cl. ..... 5/654; 5/713

(58) Field of Classification Search ..... 5/654, 5/713, 655.3, 710; 297/452.41, 284.3
See application file for complete search history.

(56) References Cited

U.S. PATENT DOCUMENTS

| | | | | |
|---|---|---|---|---|
| 2,938,570 | A | 5/1960 | Flajole | |
| 4,175,297 | A | 11/1979 | Robbins et al. | |
| 4,190,286 | A | 2/1980 | Bentley | |
| 4,617,690 | A | 10/1986 | Grebe | |
| 5,103,518 | A | 4/1992 | Gilroy et al. | |
| 5,109,560 | A | 5/1992 | Uetake | |
| 5,121,513 | A * | 6/1992 | Thomas et al. | 5/713 |
| 5,163,196 | A * | 11/1992 | Graebe et al. | 5/654 |
| 5,419,612 | A | 5/1995 | Rassekhi | |
| 5,500,965 | A | 3/1996 | Hannagan et al. | |
| 5,502,855 | A * | 4/1996 | Graebe | 5/654 |
| 5,678,265 | A * | 10/1997 | Meyer | 5/654 |
| 5,839,140 | A | 11/1998 | Wilkerson | |
| 5,963,997 | A | 10/1999 | Hagopian | |
| 6,014,784 | A | 1/2000 | Taylor et al. | |
| 6,036,271 | A | 3/2000 | Wilkinson et al. | |
| 6,115,860 | A * | 9/2000 | Vrzalik | 5/715 |
| 6,135,550 | A | 10/2000 | Tucho | |
| 6,216,299 | B1 | 4/2001 | Kohlman | |
| 6,591,437 | B1 * | 7/2003 | Phillips | 5/713 |
| 6,623,080 | B2 | 9/2003 | Clapper | |
| 6,668,405 | B1 | 12/2003 | Kohlman | |
| 2003/0159219 | A1 | 8/2003 | Harrison et al. | |
| 2004/0211004 | A1 | 10/2004 | Thompson | |
| 2006/0168734 | A1 * | 8/2006 | Glass | 5/655.3 |

OTHER PUBLICATIONS

Herman Miller, "The Art of Pressure Distribution", 2005.

* cited by examiner

*Primary Examiner*—Alexander Grosz
(74) *Attorney, Agent, or Firm*—Sherrill Law Offices, PLLC

(57) ABSTRACT

An inflatable cushion having a group of mutually inflatable and deflatable cells wherein at least one cell in the group may be selectively and repeatedly included or excluded from the group for mutual inflation and deflation when included and independent inflation and deflation when excluded.

4 Claims, 3 Drawing Sheets

CUSHION WITH GROUP OF MUTUALLY INFLATABLE AND DEFLATABLE CELLS AND SYSTEM FOR SELECTIVELY ISOLATING ONE OR MORE CELLS FROM THE GROUP FOR INDEPENDENT INFLATION AND DEFLATION

BACKGROUND

Persons with limited mobility, such as the elderly or persons confined to a wheelchair, are susceptible to the development of pressure sores. Pressure sores are formed when the tissue is compressed for extended periods of time causing a restriction in the flow of blood. The exchange of nutrients and waste in the compressed tissue cells is slowed, resulting in skin breakdown and the formation of pressure sores. The retention of heat and moisture are two additional factors that contribute to the formation of pressure sores. Areas most vulnerable to pressure sore formation are bony areas having little tissue between the bone and the skin, including such areas as the ischial tuberosities, coccyx and sacrum.

U.S. Pat. Nos. 4,175,297, 5,103,518, 5,109,560, 5,500,965, 5,839,140, 5, 963,997, 6,014,784, 6,216,299 and 6,668,405 disclose inflatable cushion systems wherein the cushion includes an array of inflatable cells including first and second interconnected groupings of cells interspersed throughout the array which are alternately inflated and deflated on a predetermined schedule in order to vary the location of contact between the cushion and the posterior of a person seated on the cushion.

While effective for reducing the development of discomfort, numbness, pain and pressure sores resulting from prolonged periods of sitting, such cushions are not suitable for use once a pressure sore has developed as the cushion continues to apply at least intermittent pressure upon the affected area causing discomfort, pain and perhaps even exacerbating the sore.

Accordingly, a continuing need exists for an inflatable cushion capable of reducing the pain and discomfort commonly experienced when an individual afflicted with a pressure sore on his/her posterior is seated.

SUMMARY OF THE INVENTION

A first embodiment of the invention is an inflatable cushion having a group of mutually inflatable and deflatable cells wherein at least one cell in the group may be selectively and repeatedly included or excluded from the group for mutual inflation and deflation when included and independent inflation and deflation when excluded.

A second embodiment of the invention is an inflatable cushion having a plurality of inflatable and deflatable cells. A first set of at least two cells are fluidly interconnected with one another whereby the cells in the first set of cells share a common inflation pressure. A second set of at least two cells are fluidly interconnected with one another whereby the cells in the second set of cells share a common inflation pressure. The first and second sets of cells are interspersed amongst one another. At least one cell in the first set is capable of selective and repeated inclusion or exclusion from the first set for mutual inflation and deflation with the first set when included and independent inflation and deflation when excluded.

DETAILED DESCRIPTION OF THE INVENTION INCLUDING A BEST MODE

Nomenclature x Central Longitudinal Axis
y Central Latitudinal Axis
z Central Transverse Axis
10 Seating Cushion
11 Top of Seating Cushion
12 Bottom of Seating Cushion
13 First Side of Seating Cushion
14 Second Side of Seating Cushion
15 Front End of Seating Cushion
16 Back End of Seating Cushion
20 Base
21 Platform Area
30 Cells
30*e* Encircling Cells
30*p* Peripheral Cells
31 First Group of Cells
32 Second Group of Cells
35 Stem
39 Void or Cavity
40 Quick Disconnect
50 Hook and Loop Tape
61*d* First Delivery Tube
61*r* First Return Tube
62*d* Second Delivery Tube
62*r* Second Return Tube
64 Manual Pump
65 Release Valve on Manual Pump
66 Manual Flow Valve
70 Cover
71 Top of Cover
72 Bottom of Cover
73 First Side of Cover
74 Second Side of Cover
75 Front of Cover
76 Back of Cover
77 Opening
78 Zipper
80 Control Box
81 First Power Switch
82 Second Power Switch
83 Battery
84 Recharging Socket
85 Recharging Unit
89 Housing
91 Air Pump
92 Check Valve
93 Main Delivery Tube
94 First Valve
95 Discharge Port
96 Second Valve
97 Second Discharge Port

Construction

Figure 1:
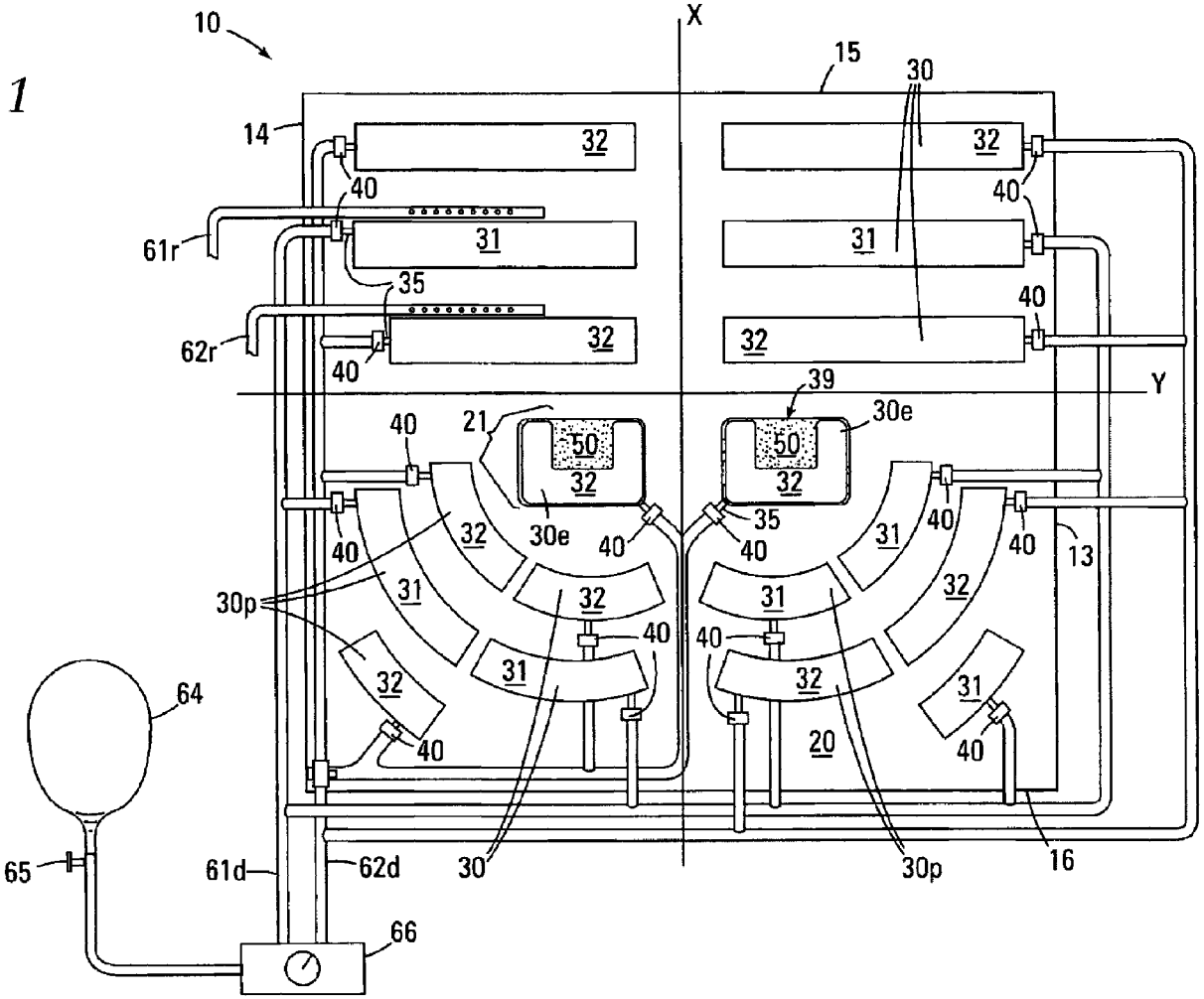
FIG. 1 is a top view of one embodiment of the invention with the cover removed to facilitate viewing of internal components.
Figure 2:
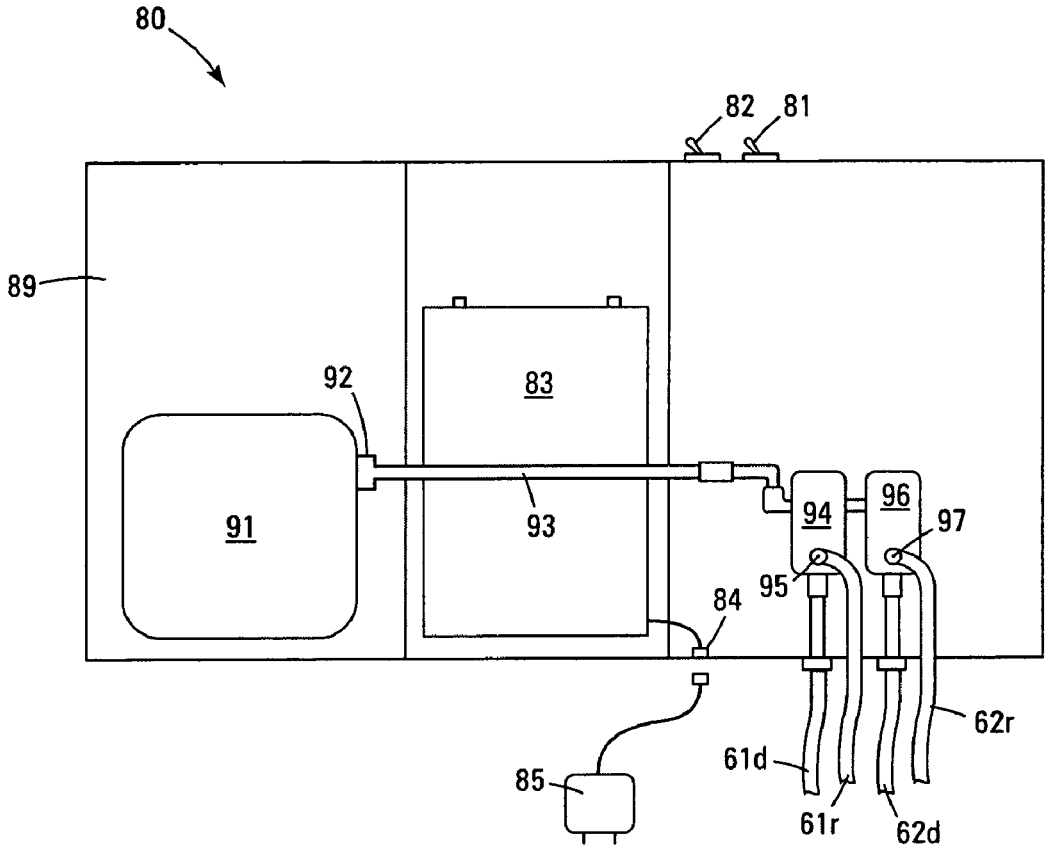
FIG. 2 is a schematic view of one embodiment of a control unit for inflation and deflation of the cells.

Referring to FIGS. 1 and 2, the seating cushion 10 includes a base 20, cells 30 and a control box 80. The seating cushion 10 can be used in connection with any type of seating including standard residential and office chairs, airplane seats, vehicle seating, etc. but is particularly suited for use in a wheelchair (not shown).

Figure 3:
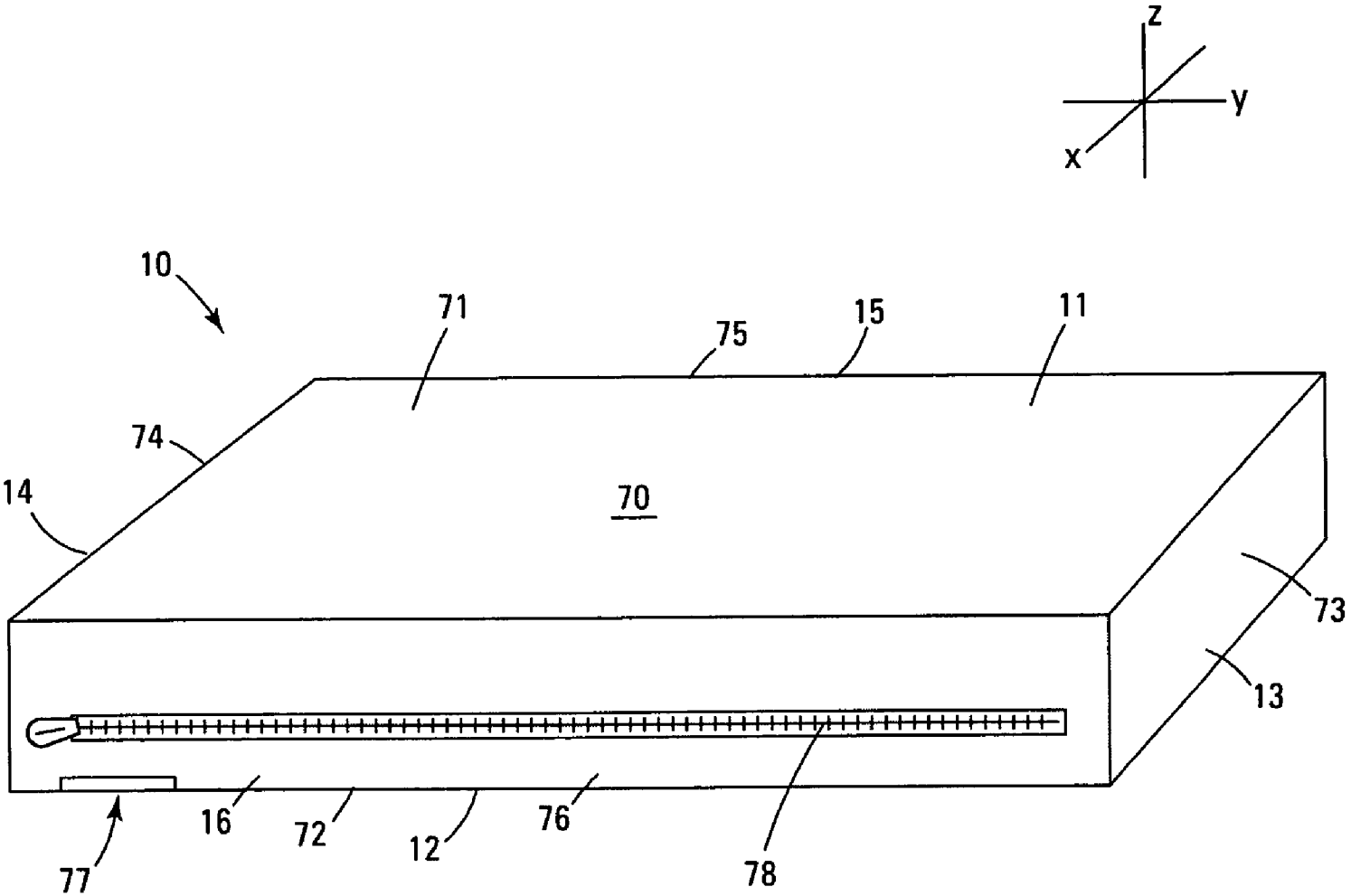
FIG. 3 is a perspective view of one embodiment of a covered cushion.

Referring to FIGS. 1 and 3, the base 20 and cells 30 define a top surface 11, a bottom surface 12, a first or right side 13, a second or left side 14, a front 15 and a back 16.

The base 20 is preferably a planar sheet of material having sufficient flexibility and structural integrity, such as rubber, neoprene, urethane, vinyl, or plastisol.

The cells 30 must be constructed from a material having sufficient structural integrity to support an individual in a seated or prone position upon the inflated cells 30. In addition, the cells 30 must be capable of withstanding repeated inflation and deflation cycles. The cells 30 are preferably constructed of a resilient material such as, but not limited to rubber, neoprene, urethane, vinyl, or plastisol.

The cells 30 are connected to the base 20 by any conventional means, including specifically, but not exclusively heat sealing, adhesive bonding or RF welding, whereby the cells 30 cannot be repositioned relative to one another on the base 20.

The cushion 10 includes a plurality of cells 30 which may have the same or different shapes and may be uniformly arranged, such as disclosed in U.S. Pat. No. 6,216,299, or randomly arranged, such as disclosed in U.S. Pat. No. 6,668,405.

As shown in FIG. 1, the cushion 10 may include a pair of laterally y spaced encircling cells 30*e* having the same or different shapes. The encircling cells 30*e* include a void or cavity 39. The void or cavity 39 in the encircling cells 30*e* allows the encircling cells 30*e* to support the perimeter of an area or protuberance (not shown) on the posterior (not shown) of a user (not shown), such as an ischial tuberosity (not shown), without directly touching the area or protuberance.

The encircling cells 30*e* may be repositionably attached to the base 20 within a platform area 21 so as to allow repositioning of the encircling cells 30*e* to corresponding with the specific location of a user's ischial tuberosities (not shown). A particularly suitable means for respositionably attaching the encircling cells 30*e* to the base 20 is with hook and loop tape 50 wherein a first half of the hook and loop tape 50 is secured to the base 20 so as to cover substantially the entire area constituting the platform area 21, and a second half of the hook and loop tape 50 secured to the lower surface (not shown) of the encircling cells 30*e*. A respositionable pressure sensitive adhesive may also be employed. Other cells 30 may also be repositionably attached to the base 20.

As shown in FIG. 1, the cushion 10 may include peripheral cells 30*p* extending concentrically or radially from each encircling cell 30*e*. The peripheral cells 30*p* may have the same or different shapes. As shown in FIG. 1, the cushion 10 can include several rows of peripheral cells 30*p* extending along several different concentric lines so as to define inner, outer and intermediate levels of peripheral cells 30*p*.

The configuration and arrangement of the cells 30 as shown in FIG. 1, including the encircling cells 30*e* and peripheral cells 30*p*, facilitates pressure relief in the areas of greatest concern for the development of pressure sores, including the ischial tuberosities, coccyx, and sacrum.

The cells 30, especially the encircling cells 30*e*, are preferably symmetrically configured and arranged on opposite sides of a central longitudinal axis x.

Each cell 30 is equipped with a stem 35. In one embodiment all the cells 30 are fluidly connected via branch lines (not separately numbered) to a single delivery tube (not shown). In a second embodiment, a first group of the cells 31 is fluidly connected to a first main delivery tube 61*d* via branch tubes (not separately numbered) interconnecting the first main delivery tube 61*d* to each of the stems 35 on the first group of cells 31, and a second group of cells 32 fluidly connected to a second main delivery tube 62*d* via branch tubes (not separately numbered) interconnecting the second main delivery tube 62*d* to each of the stems 35 on the second group of cells 32. For purposes of simplicity, the balance of the disclosure shall be provided in connection with the embodiment having two separately inflated and deflated groups of cells 31 and 32.

The branch tubes are connected to the stem 35 on each cell 30 by a quick disconnect fitting 40 which, when connected to the stem 35 places the cell 30 in fluid communication with the associated delivery tube 61*d* or 62*d*, and when disconnected from the stem 35 seals the disconnected end (unnumbered) of the delivery tube 61*d* or 62*d* and allows the stem 35 to remain biased in an open or closed position depending upon the specific type of stem 35 employed. While either type of stem 35 may be employed (i.e., normally open (vented) or normally closed (sealed)), a normally open stem 35 is preferred as cells 30 will typically be disconnected for purposes of preventing the disconnected cell 30 from contacting someone positioned upon the cushion 10.

Referring to FIG. 1, the first 31 and second 32 cell groups are symmetrically or asymmetrically distributed throughout the base 20 so that each cell group can individually support a user (not shown) seated upon the seating cushion 10. The two encircling cells 30*e* may be placed together in the same cell group or in separate cell groups as desired. In a preferred embodiment, the encircling cells 30*e* are split between the two cell groups with one of the encircling cells 30*e* in the first group 31 and the other encircling cell 30*e* in the second group 32.

Referring to FIG. 3, the base 20 and cells 30 are preferably surrounded with a removable cover 70 having a top surface 71, a bottom surface 72, a first or right side 73, a second or left side 74, a front 75 and a back 76. At least the top 71 of the cover 70 should be permeable so that air flowing from the return tubes 61*r* and 62*r* into the cover 70 can flow through the top 71 of the cover 70 and thereby ventilate the areas of contact between a user (not shown) and the cushion 10. The cover 70 can be constructed from a perforated material but is preferably constructed from a permeable fabric such as cotton or a cotton/polyester blend. If desired the cover 70 can be constructed from a gas permeable moisture impermeable material such as Gortex®.

The cover 70 is preferably provided with a zipper 78 so that the cover 70 may be removed and laundered or replaced. An opening 77, preferably along a seam (not shown) permits passage of the delivery tubes 61*d* and 62*d*, and return tubes 61*r* and 62*r* through the cover 70.

Referring to FIG. 1, the cushion 10 can be equipped with a hand-operated manual pump 64 equipped with a release valve 65 in fluid communication with the cells 30 for inflating and deflating the cells 30. A manually operated flow valve 66 can be positioned between the manual pump 64 and the cells 30 for selectively placing the manual pump 64 in fluid communication with the first group of cells 31 or the second group of cells 32.

Referring to FIG. 2, an upgraded system can replace the manual pump 64 and valve 66 with a control box 80. A suitable control box 80 is placed in fluid communication with the cells 30. Briefly, a suitable control box 80, shown in FIG. 2, includes (i) an air pump 91, (ii) a battery 83, (iii) a first three-position power switch 81 electrically connected to the battery 83, pump 91, and a first valve 94 wherein the first valve 94 fluidly interacts with the first group of cells 31, and (vi) a second three-position power switch 82 electrically connected to the battery 83, pump 91, and a second valve 96 wherein the second valve 96 fluidly interacts with the second group of cells 32.

Alternatively, when intended for use in a vehicle (not shown), heavy equipment (not shown), an electrically powered wheelchair (not shown) or other equipment having a battery (not shown), the battery 83 in the control box 80 can be eliminated and an electrical cord (not shown) with a suitable socket (not shown) and adapter (not shown) can be provided for electrically connecting the control box 80 with the vehicle battery (not shown).

A check valve 92 is preferably positioned along the main delivery tube 93 between the air pump 91 and the valves 94 and 96 for preventing airflow from reversing and entering the air pump 91 when operation of the air pump 91 is terminated.

The control box 80 allows the user (not shown) to independently control the amount of fluid pressure within each group of cells 31 and 32. The first and second three-position power switches 81 and 82 each have an OFF, INFLATE and DEFLATE position. When either of the three-position power switches 81 or 82 is switched to OFF the electrical circuit from the battery 83 to the pump 91 is opened to prevent operation of the pump 91, and the valve 94 or 96 respectively, is closed to prevent air-flow through the associated valve 94 or 96. When either of the three-position power switches 81 or 82 is switched to INFLATE the electrical circuit from the battery 83 to the pump 91 is closed to initiate operation of the pump 91, and the associated valve 94 or 96 is opened to allow air-flow from the pump 91 into the associated group of cells 31 or 32 through the associated valve 94 or 96. When either of the three-position power switches 81 or 82 is switched to DEFLATE the electrical circuit from the battery 83 to the pump 91 is opened to prevent operation of the pump 91, and the associated valve 94 or 96 is opened to allow air-flow from the pump 91 to the associated discharge port 95 or 97 through the associated valve 94 or 96.

A recharging socket 84 can be provided for electrically connecting the battery 83 to a recharging unit 85 so as to allow recharging of the battery 83.

A housing 89 supports and encloses all of the electrical components of the control box 80.

The first delivery tube 61*d* fluidly connects the first valve 94 to the first group of cells 31 for delivering pressurized fluid to the first group of cells 31 when the first power switch 81 is positioned to INFLATE and for venting pressurized fluid to the first group of cells 31 through the discharge port 95 when the first power switch 81 is positioned to DEFLATE. The second delivery tube 62*d* fluidly connects the second valve 96 to the second group of cells 32 for delivering pressurized fluid to the second group of cells 32 when the second power switch 82 is positioned to INFLATE and for venting pressurized fluid to the second group of cells 32 through the discharge port 97 when the second power switch 82 is positioned to DEFLATE.

Alternatively, the control box 80 could include (i) a two-position FIRST/SECOND switch (not shown) for selecting which of the first and second valves 94 and 96 to be energized and thereby selecting the cell group 31 or 32 to be inflated or deflated, (ii) a two-position INFLATE/DEFLATE switch (not shown) for controlling the position of the energized valve 94 or 96 as between inflation and deflation modes and preventing operation of the pump 91 when in the deflation mode, and (iii) a two-position ON/OFF power switch (not shown) for controlling operation of the pump 91.

Other switch combinations are also possible and known to those having ordinary skill in the art.

A first return tube 61*r* can be fluidly connected to the first discharge port 95 of the first valve 94. A second return tube 62*r* can be fluidly connected to the second discharge port 97 of the second valve 96. A distal end (unnumbered) of each return tube 61*r* and 62*r* is positioned between the cells 30. The return tubes 61*r* and 62*r* each include a plurality of holes (unnumbered) through the return tube 61*r* and 62*r* over that length of the return tube 61*r* and 62*r* positioned within the cover 70 for the purpose of dispersing fluid received from the respective discharge port 95 and 97 when the respective valve 94 and 96 is closed. The return tubes 61*r* and 62*r* may extend between the cells 30 in any desired configuration to achieve the desired ventilation between the cushion 10 and a user (not shown) seated upon the cushion 10.

Adjusting the primary load bearing responsibility between the first group of cells 31 and the second group of cells 32 alternates the pressure contact points between the user (not shown) and the cushion 10 and thereby reduces or eliminates the discomfort, numbness and pain which can accompany prolonged seating.

The cushion 10 may optionally be expanded to also provide lumbar support, such as disclosed in U.S. Pat. No. 6,668,405, the relevant disclosure of which is hereby incorporated by reference. The cells 30 located in the lumbar support area (not shown) can be split between and interconnected with the first 31 and second 32 group of cells 30, or may be independently interconnected to form a third group of cells (not shown).

Use

The cushion 10 may be employed as a portable overlay or may be incorporated directly into the seat (not shown).

The user (not shown), preferably while seated on the cushion 10, inflates or deflates the cells 30 in each cell group 31 and 32 to the desired pressure. At any time thereafter and on a schedule determined by the user, the user may adjust the pressure in one or both of the cell groups 31 and 32 in order to move the location of the pressure points and thereby prevent or alleviate any discomfort, numbness or pain resulting from prolonged seating.

The user may selectively disconnect one or more of the cells 30 from fluid communication with the associated delivery tube 61*d* or 62*d* as desired to prevent the selected and disconnected cells 30 from being inflated and deflated with the other cells 30 in that group and thereby permit the selected and disconnected cells 30 to be independently inflated or deflated as desired without repositioning the selected cells 30 relative to the other cells 30.

When the hand-operated manual pump 64 is employed, the user simply adjusts the manual flow valve 66 to place the pump 64 into fluid communication with one of the cell groups 31 or 32, and then either squeezes the pump 64 to inflate or opens release valve 65 to deflate the selected cell group 31 or 32.

When control box 80 with the two, three-position power switches 81 and 82 is employed, the user simply selects the three-position power switch 81 or 82 corresponding to the cell group 31 or 32 which the user desires to inflate or deflate, and then either moves the selected switch 81 or 82 from OFF to INFLATE in order to inflate the corresponding cell group 31 or 32 or moves the selected switch 81 or 82 from OFF to DEFLATE in order to deflate the corresponding cell group 31 or 32. The user returns the power switch 81 or 82 back to the OFF position when the desired pressure in the cell group 31 or 32 is achieved.

When control box 80 with the three, two-position power switches (not shown) is employed, the user simply (i) positions the FIRST/SECOND switch (not shown) to correspond with the cell group 31 or 32 to be inflated or deflated, (ii) positions the INFLATE/DEFLATE switch (not shown) to the desired inflation/deflation mode, and then (iii) moves the ON/OFF power switch (not shown) to ON until the desired pressure level in achieved in the selected cell group 31 or 32. The user returns the ON/OFF switch to OFF once the desire pressure level is achieved.

I claim:

1. An inflatable cushion comprising a group of mutually inflatable and deflatable cells wherein at least two nonadjacent cells in the group may be selectively and repeatedly included or excluded from the group for mutual inflation and deflation when included and independent inflation and deflation when excluded without repositioning of the at least two nonadjacent cells relative to the other cells.

2. The inflatable cushion of claim 1 wherein at least 50% of the cells in the group may be selectively and repeatedly included or excluded from the group for mutual inflation and deflation when included and independent inflation and deflation when excluded.

3. The inflatable cushion of claim 1 wherein at least 80% of the cells in the group may be selectively and repeatedly included or excluded from the group for mutual inflation and deflation when included and independent inflation and deflation when excluded.

4. The inflatable cushion of claim 1 wherein all of the cells in the group may be selectively and repeatedly included or excluded from the group for mutual inflation and deflation when included and independent inflation and deflation when excluded.

* * * * *